US009527689B2

(12) United States Patent
Takami

(10) Patent No.: US 9,527,689 B2
(45) Date of Patent: Dec. 27, 2016

(54) IMAGE FORMING APPARATUS INCLUDING RE-CONVEYING UNIT

(71) Applicant: Brother Kogyo Kabushiki Kaisha, Nagoya-shi, Aichi-ken (JP)

(72) Inventor: Takeshi Takami, Inazawa (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/995,359

(22) Filed: Jan. 14, 2016

(65) Prior Publication Data

US 2016/0214813 A1 Jul. 28, 2016

(30) Foreign Application Priority Data

Jan. 26, 2015 (JP) ..... 2015-012581

(51) Int. Cl.
*B65H 5/06* (2006.01)
*B65H 85/00* (2006.01)
*B65H 29/12* (2006.01)

(52) U.S. Cl.
CPC ..... *B65H 5/062* (2013.01); *B65H 29/125* (2013.01); *B65H 85/00* (2013.01); *B65H 2404/142* (2013.01); *B65H 2404/143* (2013.01); *B65H 2404/144* (2013.01); *B65H 2404/1421* (2013.01); *B65H 2404/1526* (2013.01)

(58) Field of Classification Search
CPC ..... B65H 5/062; B65H 15/00; B65H 29/125; B65H 85/00; B65H 2404/142; B65H 2404/1421; B65H 2404/143; B65H 2404/144; B65H 2404/1526
USPC ..... 271/274, 65, 186, 314
See application file for complete search history.

(56) References Cited

U.S. PATENT DOCUMENTS

| | | | | |
|---|---|---|---|---|
| 8,490,969 | B2 * | 7/2013 | Sawamura | B65H 29/125 271/207 |
| 8,840,110 | B2 * | 9/2014 | Tamura | B65H 5/062 271/272 |
| 2004/0245715 | A1 * | 12/2004 | Zheng | B65H 5/062 271/274 |
| 2007/0222144 | A1 * | 9/2007 | Inui | B65H 9/166 271/291 |
| 2012/0104678 | A1 | 5/2012 | Iino et al. | |

(Continued)

FOREIGN PATENT DOCUMENTS

| | | |
|---|---|---|
| JP | 2012-096858 A | 5/2012 |
| JP | 2014-193758 A | 10/2014 |

*Primary Examiner* — David H Bollinger
(74) *Attorney, Agent, or Firm* — Banner & Witcoff, Ltd.

(57) ABSTRACT

An image forming apparatus includes an image forming unit and a re-conveying unit to re-convey a sheet in a re-conveying direction. The re-conveying unit includes a first roller, a second roller, a pressing member, and a regulating member. The first roller is configured to rotate about a first axis and has a surface made from rubber. The second roller faces the first roller and is configured to rotate about a second axis inclined with respect to the first axis. The second roller has a first end portion and a second end portion positioned upstream of the first end portion. The pressing member is configured to exert resilient force to urge the second roller toward the first roller. The regulating member is configured to restrict the first end portion or the second end portion from moving toward the first roller, and is positioned adjacent to the second end portion.

7 Claims, 8 Drawing Sheets

(56) References Cited

U.S. PATENT DOCUMENTS

2014/0291929 A1* 10/2014 Nguyen ..... B65H 85/00
271/274

* cited by examiner

IMAGE FORMING APPARATUS INCLUDING RE-CONVEYING UNIT

CROSS REFERENCE TO RELATED APPLICATION

This application claims priority from Japanese Patent Application No. 2015-012581 filed Jan. 26, 2015. The entire content of the priority application is incorporated herein by reference.

TECHNICAL FIELD

The present disclosure relates to an image forming apparatus for forming an image on a sheet.

BACKGROUND

Among the various conventional image forming apparatuses in the art, there are conventional image forming apparatuses provided with a sheet re-conveying unit. The re-conveying unit includes two sets of roller pairs each of which includes a first roller and a second roller. The second roller has a rotation axis inclined with respect to a rotation axis of the first roller. An urging member such as a spring urges the second roller toward the first roller.

SUMMARY

The present inventor has investigated quality of image formed under the condition that a re-conveying unit includes such first and second rollers and the peripheral surface area of the first roller is in contact with the sheet and is made from an elastic material providing high friction coefficient such as rubber, and under the condition that the peripheral surface area of the second roller is in contact with the sheet and is made from a material having a hardness higher than that of the rubber.

As a result of the investigation, the present inventor has found that a specific portion of the rubber is worn and is adhered onto the re-conveyed sheet in accordance with an increase in operation period of the image forming apparatus. Thus, imaging quality is degraded.

It is therefore an object of the present disclosure to provide an image forming apparatus provided with a re-conveying unit capable of suppressing degradation of imaging quality.

According to one aspect, an image forming apparatus includes an image forming unit configured to form an image on a sheet and a re-conveying unit. The re-conveying unit includes a first roller, a second roller, a pressing member, and a regulating member. The re-conveying unit is configured to re-convey the sheet on which an image is formed toward the image forming unit in a re-conveying direction. The first roller is configured to rotate about a first axis perpendicular to the re-conveying direction. The first roller has a first circumferential surface made from rubber and configured to contact with the sheet. The second roller faces the first roller and has a second circumferential surface which is configured to contact with the sheet and is made from material more rigid than the rubber. The second roller is configured to rotate about a second axis inclined with respect to the first axis. The second roller has a first end portion and a second end portion in a direction of the second axis. The second end portion is positioned upstream of the first end portion in the re-conveying direction. The pressing member is configured to exert resilient force to urge the second roller toward the first roller. The regulating member is configured to restrict at least one of the first end portion and the second end portion from moving toward the first roller. The regulating member is positioned adjacent to the second end portion.

BRIEF DESCRIPTION OF THE DRAWINGS

The particular features and advantages of the disclosure as well as other objects will become apparent from the following description taken in connection with the accompanying drawings, in which.

DETAILED DESCRIPTION

Figure 1:
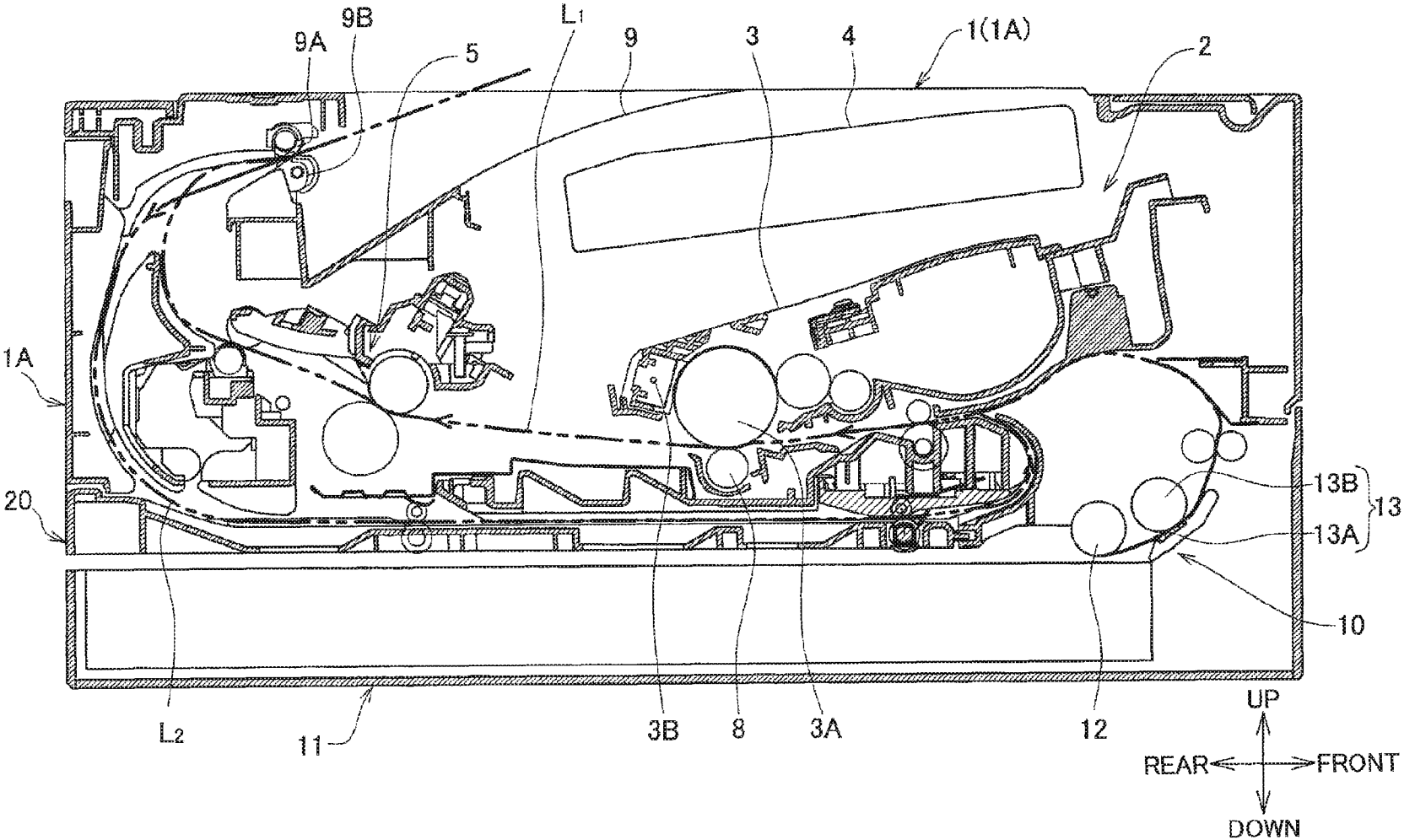
FIG. 1 is a cross-sectional view of an image forming apparatus according to one embodiment.

The embodiment pertains to an electro-photographic type image forming apparatus such as a laser printer. Arrows in the drawings represent directions for better understanding of relationship between the drawings. The embodiment should not be recognized to limit to directions shown in each drawings. Further, each part and component described in the specification should be recognized as at least one part or component, unless described as "a plurality of" and "at least two," for example.

First Embodiment

1. Overall Structure of Image Forming Apparatus

As shown in FIG. 1, the image forming apparatus 1 includes an image forming unit 2, a sheet supply unit 10, and a sheet re-conveying unit 20. The image forming unit 2 is configured to form an image on a sheet such as a paper sheet and OHP sheet, which will be referred to as the "sheet S" hereinafter. The sheet supply unit 10 is configured to supply sheets S to the image forming unit 2. The re-conveying unit 20 is configured to re-convey the sheet S discharged from the image forming unit 2 toward an inlet side of the image forming unit 2.

The image forming unit 2 is a monochoromatic type including a process cartridge 3, an exposure unit 4, and a fixing unit 5. The process cartridge 3 is provided with a photosensitive drum 3A on which developing agent (toner) is carried, and a charger 3B for charging the photosensitive drum 3A.

The photosensitive drum 3A charged by the charger 3B is exposed to light by the exposure unit 4, so that an electrostatic latent image is formed on the outer peripheral surface of the photosensitive drum 3A. Then, the developing agent is supplied to the photosensitive drum 3A, so that a visible toner image is carried on the outer peripheral surface of the photosensitive drum 3A.

A transfer roller 8 is provided at a position in confrontation with the photosensitive drum 3A. The transfer roller 8 is configured to transfer the toner image carried on the photosensitive drum 3A onto the sheet. The fixing unit 5 is configured to fix the toner image to the sheet. Such operations are performed during travel of the sheet S along a conveyer passage L1.

A discharge tray 9 is configured to receive the sheets S on which an image forming operation has been completed. Here, the completion can be defined as the case in which an image is formed on only one side of the sheet S in a simplex printing mode, or a case in which an image is formed on both sides of the sheet S in a duplex printing mode.

A discharge roller 9A is configured to impart conveying force on the sheet S by rotating in contact with the sheet S discharged from the fixing unit 5. The discharge roller 9A provides a sheet discharging function for discharging the sheet S to the discharge tray 9, and also provides a sheet re-conveying function described later. A pinch roller 9B is configured to urge the sheet S toward the discharge roller 9A.

The re-conveying function is activated in a state where the image has been formed on one side of the sheet S in the duplex printing mode. More specifically, by the re-conveying function, the conveying direction of the sheet S is reversed after an image has been formed on one side of the sheet S, and the sheet S is conveyed onto a re-conveying passage L2.

The sheet supply unit 10 includes a sheet supply tray 11, a pick-up roller 12, and a separation mechanism 13. The sheet supply tray 11 is configured to accommodate a stack of sheets S to be conveyed to the image forming unit 2.

The pick-up roller 12 is configured to supply the sheet S on the sheet supply tray 11 toward the image forming unit 2. The separation mechanism 13 includes a separation pad 13A and a separation roller 13B. In the separation mechanism 13, a plurality of sheets S supplied from the pick-up roller 12 are separated so that each one of the sheets S can be supplied to the image forming unit 2.

2. Re-Conveying Unit 2.1 Overall Structure of Re-Conveying Unit

The re-conveying unit 20 constitutes a part of the re-conveying path L2 for re-conveying the sheet S discharged from the image forming unit 2 to an inlet side of an image forming unit 2. The re-conveying path L2 is a conveying path used in a re-conveying operation for re-conveying the sheet S, on which the image formation to one side is performed, to the image forming unit 2 in the duplex printing mode.

The re-conveying unit 20 is detachably inserted and mounted to an main body 1A. The main body 1A is a housing in which the image forming unit 2 or the like is accommodated, and is a frame including a reinforcing member. The detachment or attachment direction of the re-conveying unit 20 coincides with the conveying direction D (in this embodiment, the front-rear direction) of the sheet S in the re-conveying unit 20.

Figure 2:
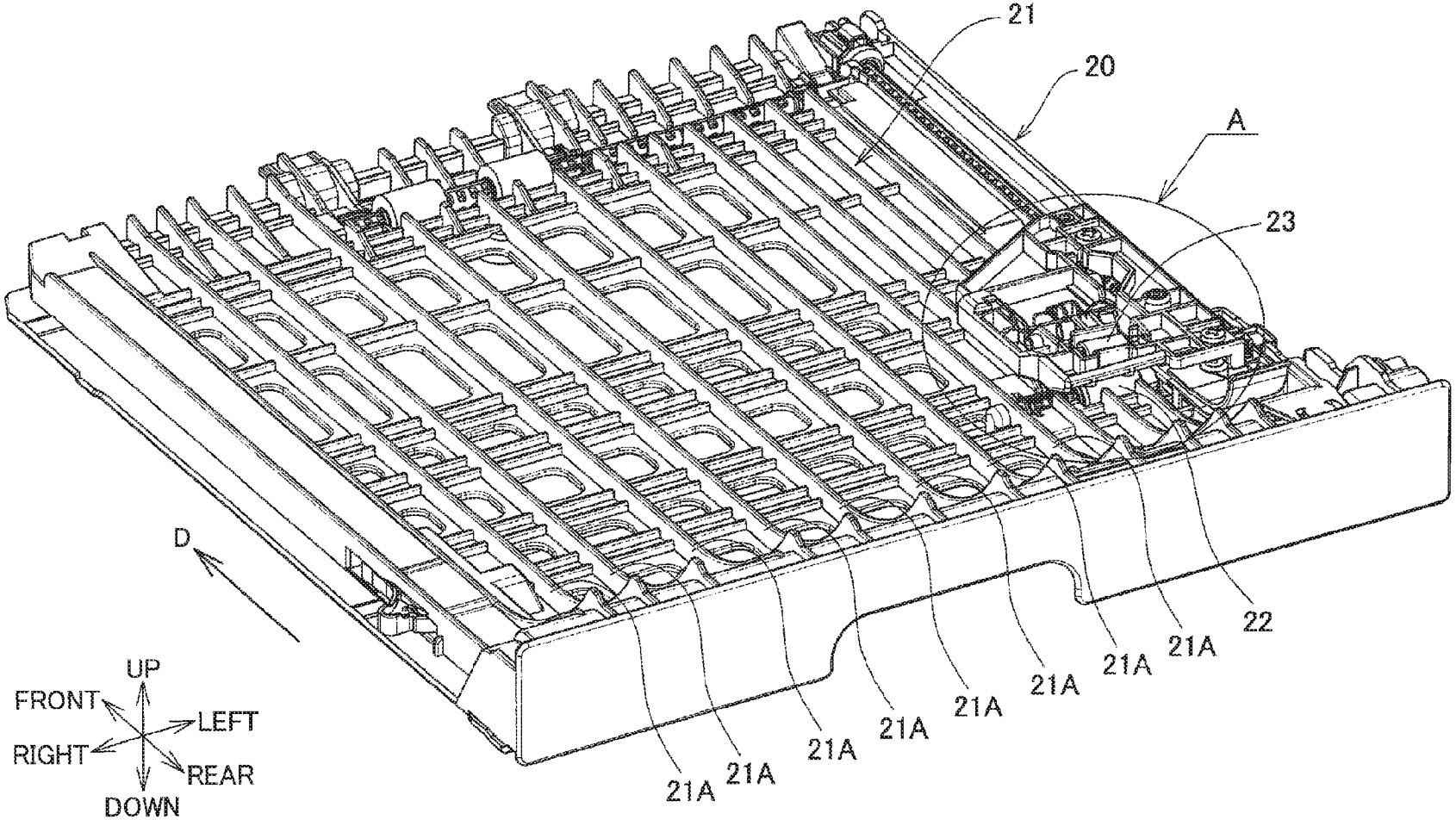
FIG. 2 is a perspective view of a re-conveying unit in the image forming apparatus according to the embodiment.

As illustrated in FIG. 2, the re-conveying unit 20 includes a conveyance tray 21, a first roller 22, and a second roller 23. The conveyance tray 21 guides the sheet conveyance to constitute at least a part of the re-conveying path L2.

A plurality of protrusions 21A are provided on the conveyance tray 21. The protrusions 21A extend in a direction parallel to the conveying direction D of the sheet. Ridge-shaped tips of the protrusion 21A slide in contact with (hereinafter, also referred to as sliding-contact) the lower surface of the sheet S to guide the sheet conveyance.

Figure 3:
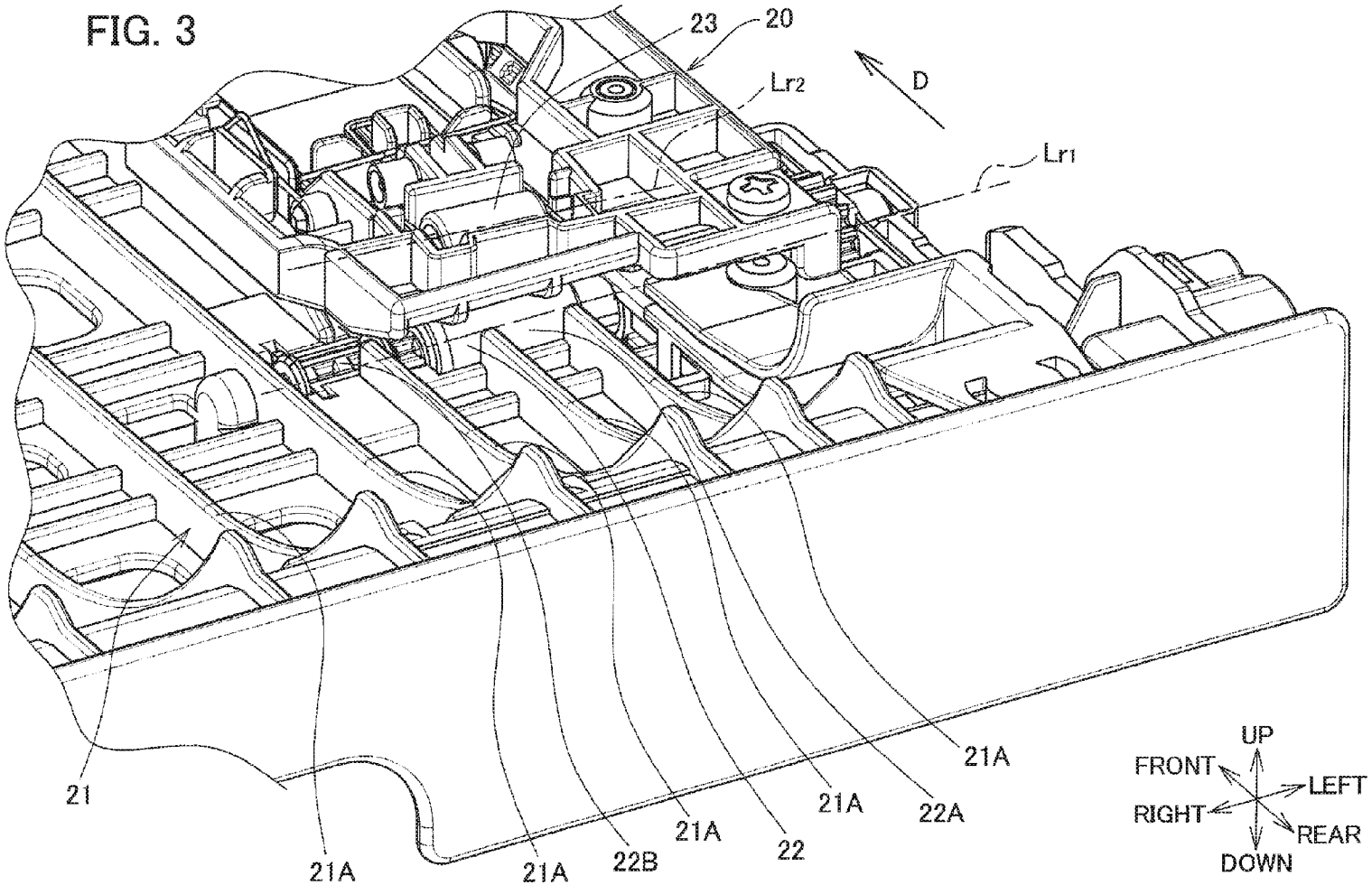
FIG. 3 is an enlarged view of a portion A encircled by a circle of FIG. 2.
Figures 4A, 4B:
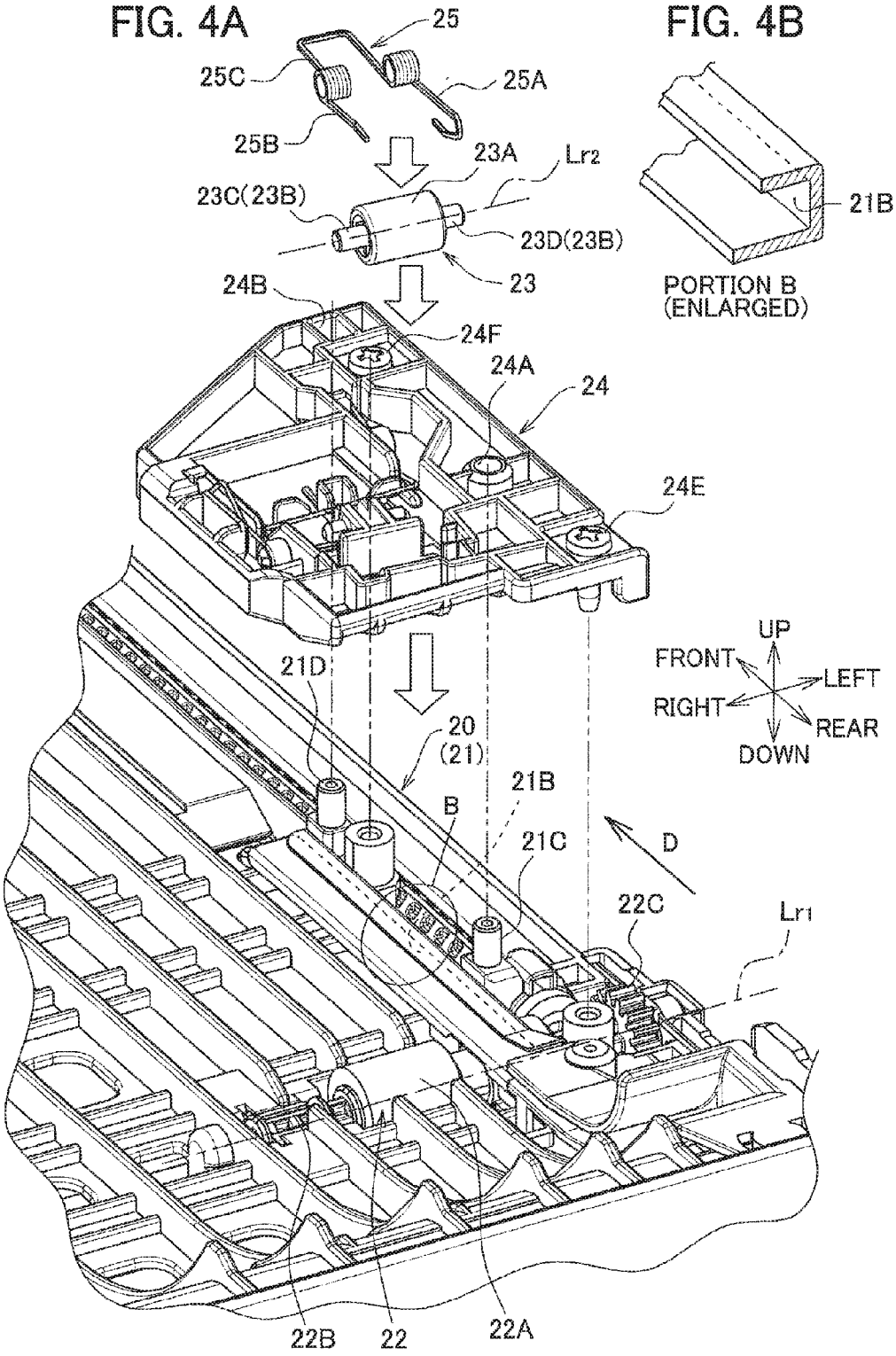
FIG. 4A is an exploded perspective view of the portion A illustrated in FIG. 3.
FIG. 4B is an enlarged view with a cross-section illustrating a portion B of FIG. 4.

As illustrated in FIG. 3, the first roller 22 has a rotation axis Lr1 that is perpendicular to the conveying direction D of the sheet S in the re-conveying unit 20. That is, as illustrated in FIG. 4A, the first roller 22 has a first roller portion 22A and a first shaft portion 22B. The rotation axis Lr1 is one example of the first axis.

The first roller portion 22A is a rotor having a cylindrical or columnar shape. The circumferential surface of the first roller portion 22A can contact with the sheet S, and is made from rubber (for example, EPDM). The first shaft portion 22B supports the first roller portion 22A, and imparts a rotational force to the first roller portion 22A.

The driving force is supplied to the first shaft portion 22B from the main body 1A. A gear 22C is provided on one axial end portion of the first shaft portion 22B. When the re-conveying unit 20 is mounted on the main body 1A, the gear 22C is engaged with a driving gear (not illustrated) provided in the main body 1A.

The second roller 23 is disposed at a position facing the first roller 22 so that the second roller 23 can press the sheet S against the first roller 22. The second roller 23 has a second roller portion 23A and a second shaft portion 23B.

The second roller portion 23A is a rotor having a cylindrical or columnar shape. The circumferential surface of the second roller portion 23A can contact with the sheet S, and is made from a material harder than rubber (for example, POM). The second shaft portion 23B supports the second roller portion 23A such that the second roller portion 23A can rotate.

Figure 5:
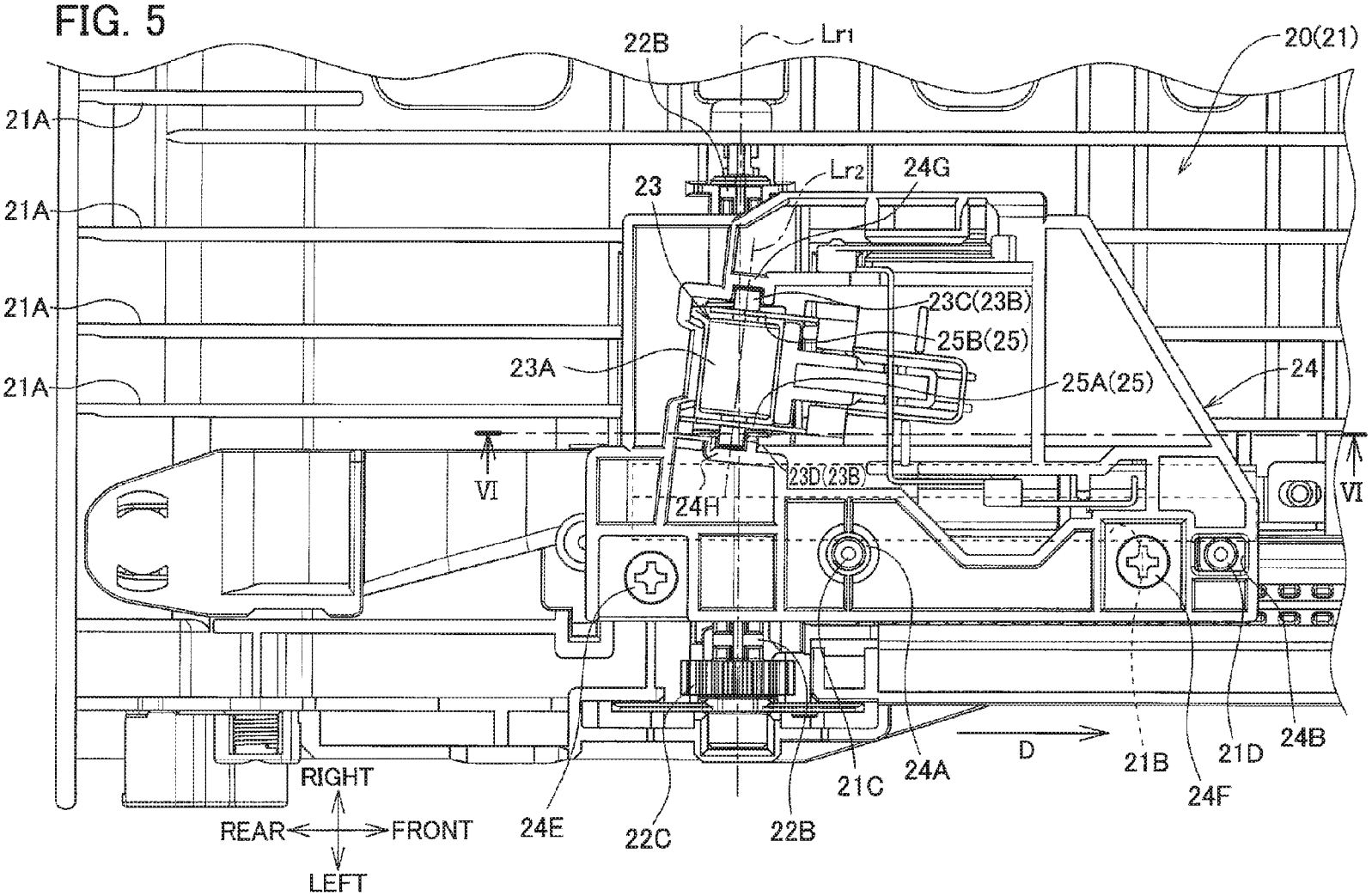
FIG. 5 is an enlarged plan view of the portion A of FIG. 2.

As illustrated in FIG. 5, the second roller 23 has a rotation axis Lr2 inclined with respect to the rotation axis Lr1 of the first roller 22, and in other words, the second roller portion 23A is inclined with respect to the rotation axis Lr1. The rotation axis Lr2 is an example of the second axis.

As illustrated in FIG. 5, the second shaft portion 23B has end portions in the direction of rotation axis Lr2, which are defined as a first end portion 23C positioned right side and a second end portion 23D positioned left side. That is, the second shaft portion 23B has the first end portion 23C positioned downstream and the second end portion 23D positioned upstream in the conveying direction D (or moving direction) of the sheet. The first end portion 23C is hereinafter also referred to as a right end portion, and the second end portion 23D is also referred to as a left end portion.

Because of the inclination of the rotation axis Lr2, the sheet S on the re-conveying unit 20 is moved in the direction from the first end portion 23C to the second end portion 23D while being conveyed during the re-conveying operation.

Specifically, the sheet S interposed by the first roller 22 and the second roller 23 is brought closer to the left side of the image forming apparatus 1, while being conveyed toward the front side of the image forming apparatus 1. Thus, the posture of the conveyed sheet S is corrected to follow the left end side of the re-conveying unit 20, i.e., a wall surface of a guide wall 21B (see FIG. 4B) positioned in the vicinity of the gear 22C.

2.2 Mounting Structure of Second Roller

As illustrated in FIG. 4A, the second roller 23 is assembled to the conveyance tray 21 via a mounting plate 24. The mounting plate 24 is provided with positioning holes 24A and 24B.

As illustrated in FIG. 5, cylindrical positioning bosses 21C and 21D are provided on the conveyance tray 21, and are inserted in holes 24A and 24B. Thus, the position of the mounting plate 24 with respect to the conveyance tray 21 is determined and fixed. Screws 24E and 24F fix the mounting plate 24 to the conveyance tray 21.

A pair of bearing portions 24G and 24H are provided on the mounting plate 24. The pair of bearing portions 24G and 24H regulate movement of the second roller 23 in the conveying direction D (in this embodiment, the front-rear direction). Specifically, the second shaft portion 23B comes into sliding-contact with the pair of bearing portions 24G and 24H when the second shaft portion 23B is displaced in the conveying direction D. The displacement of the second shaft portion 23B is therefore restricted within a predetermined range.

A pressing member 25 is a spring member that generates a resilient force for pressing the second roller 23 against the first roller 22. The pressing member 25 includes a first pressing member 25A and a second pressing member 25B.

The first pressing member 25A presses the second end portion 23D of the second shaft portion 23B positioned left side. The second pressing member 25B presses the first end portion 23C positioned right side.

As illustrated in FIG. 4A, the first pressing member 25A and the second pressing member 25B are integrally formed, and have two torsion coil springs.

Figure 6:
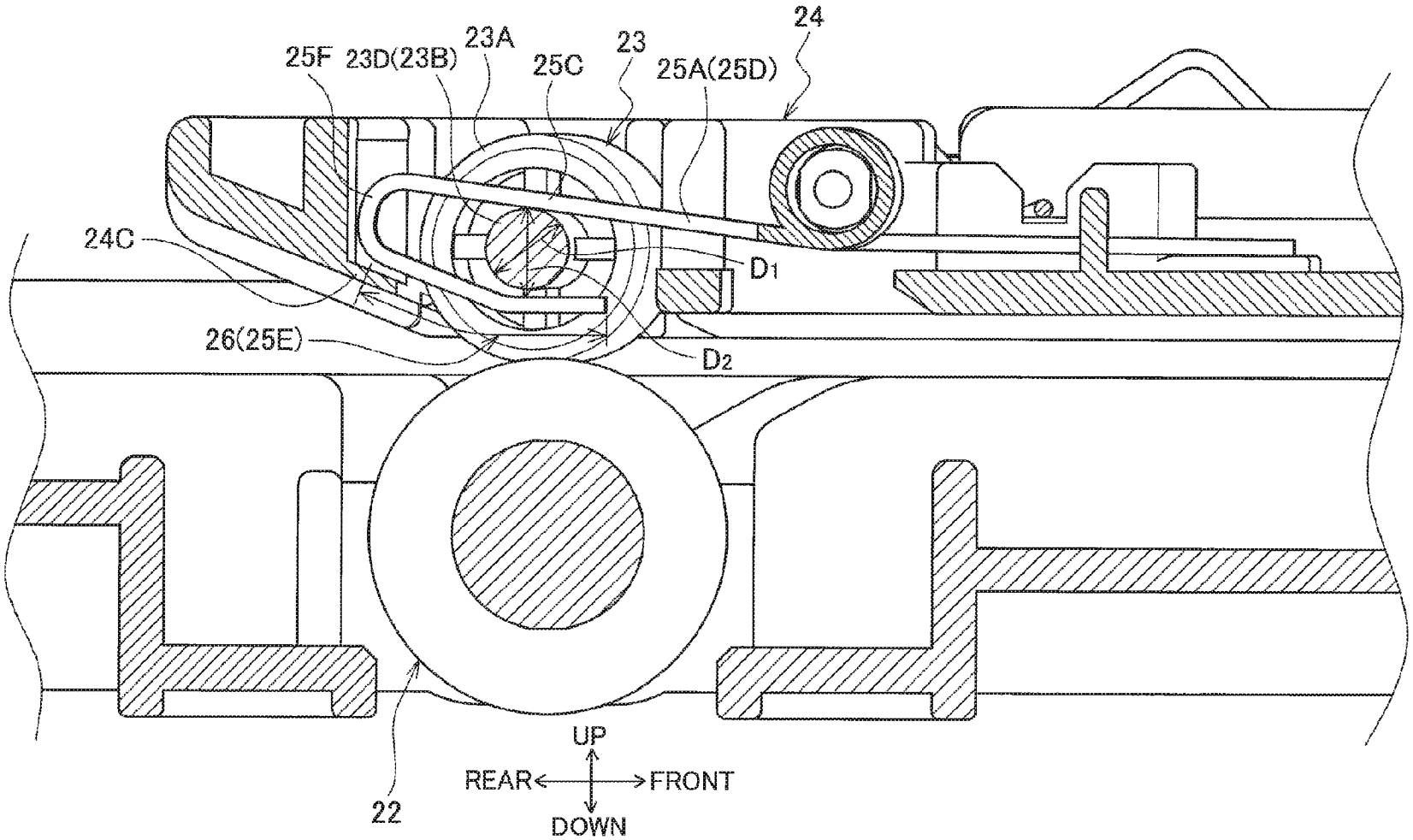
FIG. 6 is a cross-sectional view taken along a line VI-VI in FIG. 5.

As illustrated in FIG. 6, a regulating member 26 is provided adjacent to the second end portion 23D of the second shaft portion 23B, i.e., the left end portion of the second shaft portion 23B as illustrated in FIG. 5.

Figure 7:
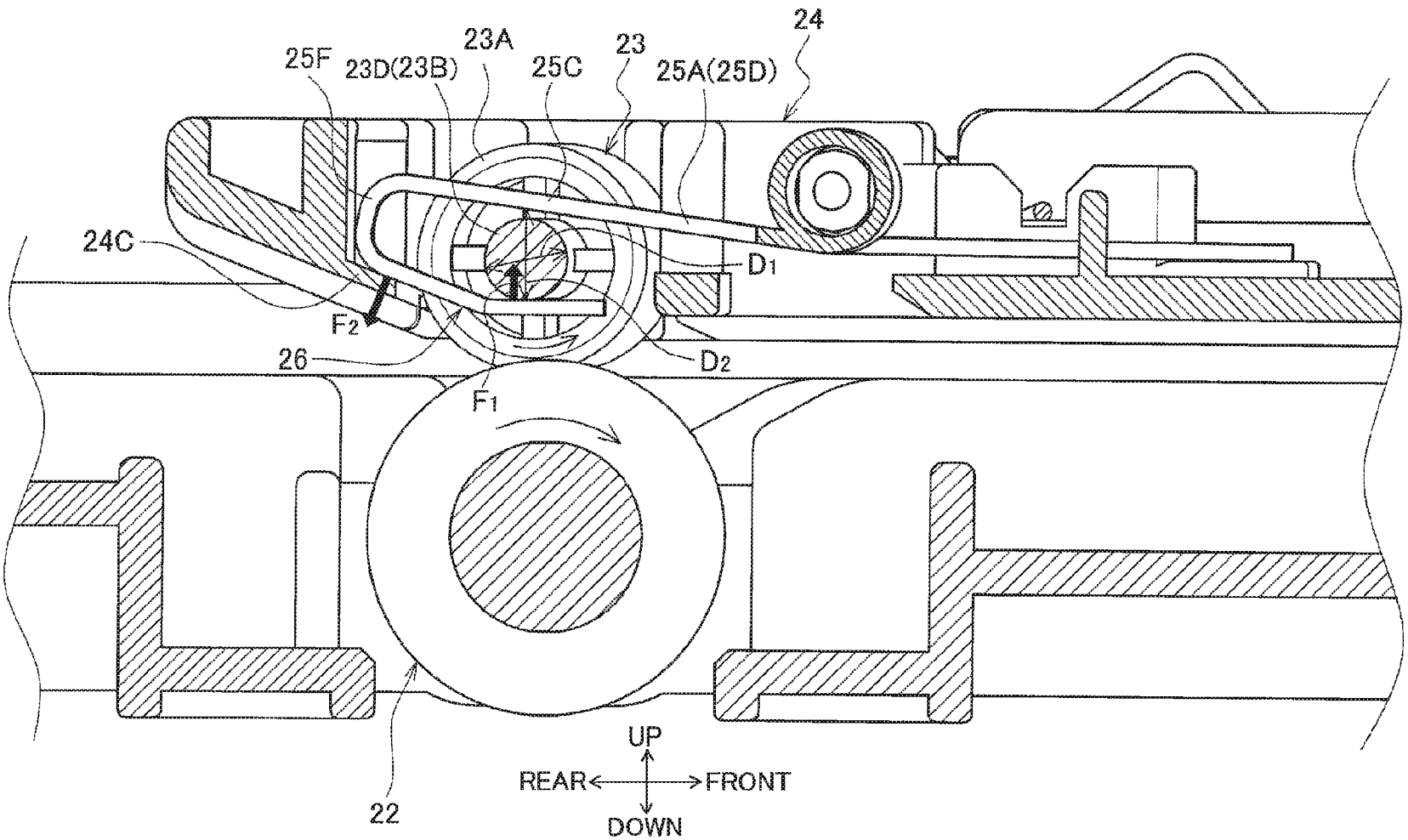
FIG. 7 is a cross-sectional view taken along a line VI-VI in FIG. 5 and illustrating a state where a second roller is in contact with a regulating member.

The regulating member 26 restricts the displacement of the second end portion 23D toward the first roller 22 within a predetermined range. Specifically, as illustrated in FIG. 7, when the displacement of the second roller 23 toward the first roller 22 reaches a predetermined dimension, the second end portion 23D (i.e., the left end portion) of the second shaft portion 23B comes into contact with the regulating member 26. Accordingly, the movement and displacement of the second roller 23 are regulated.

The regulating member 26 is made of resilient material that is resiliently deformable, and exerts a regulation force F1 that regulates the displacement of the second roller 23 by being resiliently deformed. The mounting plate 24 is provided with a receiving portion 24C that receives the reaction force F2 against the regulation force F1. The reaction force F2 is one of the forces exerted on the regulating member 26. As described above, the re-conveying unit 20 has the receiving portion 24C, the second roller 23, the first pressing member 25A, and the regulating member 26.

That is, when the second roller 23 is displaced toward the first roller 22, the second end portion 23D (i.e., the left end portion) of the second shaft portion 23B comes into contact with the regulating member 26 (FIG. 7). Since a front end portion of the wire-shaped (or linear shaped) regulating member 26 is resiliently deformed toward the first roller 22, the regulation force F1 is generated.

Simultaneously, a root portion (i.e., the rear portion) of the regulating member 26 comes into contact with the receiving portion 24C, and the receiving portion 24C receives the reaction force F2 against the regulation force F1.

As illustrated in FIG. 6, the first pressing member 25A and the regulating member 26 are integrally formed of a wire rod 25C. The wire rod 25C is a wire (rod-shaped) member made of metal such as spring steel.

The wire rod 25C has a first portion 25D, a second portion 25E and a third portion 25F, and is formed in a substantially U-shape. That is, the first portion 25D is located opposite to the first roller 22 with respect to the second shaft portion 23B and the second roller 23, and constitutes at least a part of the first pressing member 25A.

The second portion 25E is positioned opposite to the first portion 25D with respect to the second shaft portion 23B and the second roller 23 to constitute at least a part of the regulating member 26. The third portion 25F connects the first portion 25D and the second portion 25E, and is bended in a U-shape.

The diameter D1 of the second shaft portion 23B is smaller than the distance D2 between the first pressing member 25A and the regulating member 26. That is, the dimension of the part of the second roller 23 that receives the force from the first pressing member 25A and the regulating member 26 is smaller than the distance D2 between the first pressing member 25A and the regulating member 26.

Therefore, when a force (hereinafter, referred to as a displacement force) that displaces the left end portion of the second shaft portion 23B toward the first roller 22 is not exerted, the regulating member 26 and the second shaft portion 23B are in a non-contact state, as illustrated in FIG. 6. In other words, when the first roller 22 is not rotating, the regulating member 26 does not contact with the second shaft portion 23B.

Since the displacement force acts on the second roller 23 when the first roller 22 begins to rotate, as described later, the second end portion 23D (i.e., the left end portion) of the second shaft portion 23B is displaced toward the first roller 22. Accordingly, the regulating member 26 and the second shaft portion 23B come into contact with each other.

3. Characteristics of Image Forming Apparatus According to This Embodiment

The inventor has found that "Rotation of the second roller 23, which is inclined with respect to and in contact with the first roller 22, generates a moment M1 for rotating the left end portion of the second shaft portion 23B toward the first roller 22".

Figure 8:
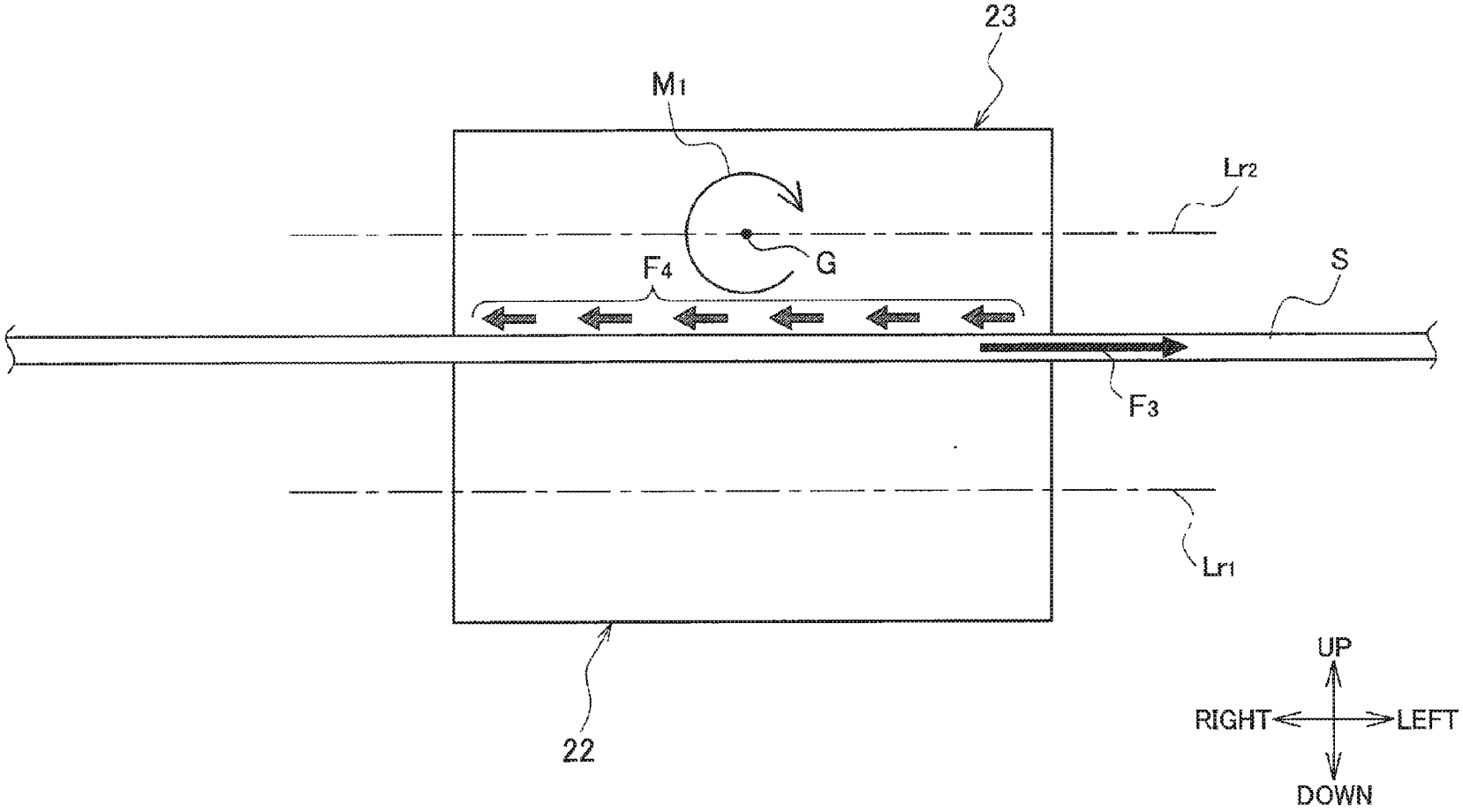
FIG. 8 is a view for description of moment generated in a second roller in the image forming apparatus according to the embodiment.

That is, as described above, when the first roller 22 and the second roller 23 rotate in contact with each other in a state where the second roller 23 is inclined with respect to the first roller 22, the force pushing leftward is exerted on the sheet S interposed between the first roller 22 and the second roller 23 (hereinafter, referred to as a pushing force F3), as illustrated in FIG. 8.

In response to this, since the reaction force F4 against the pushing force F3 is generated on the outer circumferential surface of the second roller 23, the moment M1 about the center of gravity G caused by the reaction force F4 is exerted on the second roller 23. Accordingly, the moment M1 generates a force in a direction in which the second end portion 23D (i.e., the left end portion) of the second shaft portion 23B is moved toward the first roller 22.

Further, when the second end portion 23D bites into the outer circumferential surface of the first roller 22 by the moment Ml, uneven wear occurs and a part of the outer circumferential surface made of rubber is scraped. Accordingly, wear particles are generated by the uneven wear, and cause deterioration in image quality.

In this embodiment, in order to prevent the deterioration in image quality, the regulating member 26 is provided to regulate the displacement of the second end portion 23D toward the first roller 22. Since the generation of abrasion powder can be suppressed by preventing the uneven wear, the deterioration in image quality can be reduced.

The regulating member 26 according to this embodiment can contact with the second shaft portion 23B to regulate the displacement of the second roller 23. If compared to a configuration in which the regulating member 26 comes into contact with the second roller portion 23A, the rotational resistance of the second roller 23 can be reduced. Further, contact between the regulating member 26 and the conveyed sheet S can be suppressed.

In this embodiment, the regulating member 26 is made of or made from resilient material that is resiliently deformable, and generates the regulation force that regulates the displacement of the second roller 23 by being resiliently deformed. In addition, the re-conveying unit 20 is provided with the receiving portion 24C that receives the reaction force against the regulation force acting on the regulating member 26. Accordingly, the dimensional variation or dimension error of the second roller 23 and the regulating member 26 can be absorbed. Incidentally, the dimensional variation or dimension error according to the embodiment is within at most a dimensional tolerance range.

In this embodiment, the diameter D1 of the second shaft portion 23B (i.e., the part of the second roller 23 that receives the force from the first pressing member 25A and the regulating member 26) is smaller than the distance D2 between the first pressing member 25A and the regulating member 26.

Accordingly, the second roller 23 is configured to come into contact with one of the first pressing member 25A and the regulating member 26. Therefore, the rotational resistance can be reduced if compared to a case where the second roller 23 is in contact with both of the first pressing member 25A and the regulating member 26.

In this embodiment, the first pressing member 25A, the second pressing member 25B, and the regulating member 26 are integrated. Accordingly, when the pressing member 25 is mounted in the re-conveying unit 20, mounting of the regulating member 26 can be simultaneously completed. The deterioration in image quality can be suppressed without causing increment of assembly process and without requiring enormous improvements to the re-conveying unit 20.

Other Embodiments

The regulating member 26 according to the embodiment can slide in contact with the second shaft portion 23B, and the present disclosure is not limited to the configuration. The regulating member 26 may come into sliding-contact with the second roller portion 23A.

In the embodiment, the first pressing member 25A and the regulating member 26 are integrally formed of the wire rod 25C, and the wire rod 25C is formed in a substantially U-shape. The present disclosure is not limited to the configuration. For example, the first pressing member 25A and the regulating member 26 may be separated members.

The regulating member 26 according to the embodiment regulates the displacement of the second roller 23 by being resiliently deformed. The present disclosure is not limited to the configuration. For example, the mounting plate 24 may be provided with a rigid body such as a stopper that comes into contact with the second shaft portion 23B to regulate the displacement of the second roller 23.

In the embodiment, the diameter D1 of the second shaft portion 23B is smaller than the distance D2 between the first pressing member 25A and the regulating member 26, and the disclosure is not limited to the configuration.

The above-described embodiment pertains to the monochromatic electro-photographic type image forming apparatus 1. In addition, a color printer may be applied to the embodiment or the disclosure.

While the description has been described in detail with reference to the specific embodiments thereof, it would be apparent to those skilled in the art that various changes and modifications may be made therein without departing from the scope of the invention.

What is claimed is:

1. An image forming apparatus comprising:

an image forming unit configured to form an image on a sheet; and a re-conveying unit configured to re-convey the sheet on which an image is formed toward the image forming unit in a re-conveying direction, the re-conveying unit comprising:

a first roller configured to rotate about a first axis perpendicular to the re-conveying direction, the first roller having a first circumferential surface made from rubber and configured to contact with the sheet;

a second roller facing the first roller and having a second circumferential surface which is configured to contact with the sheet and is made from material more rigid than the rubber, the second roller being configured to rotate about a second axis inclined with respect to the first axis, the second roller having a first end portion and a second end portion in a direction of the second axis, the second end portion positioned upstream of the first end portion in the re-conveying direction;

a pressing member configured to exert resilient force to urge the second roller toward the first roller; and a regulating member configured to restrict at least one of the first end portion and the second end portion from moving toward the first roller, the regulating member positioned adjacent to the second end portion.

2. The image forming apparatus according to claim 1, wherein the regulating member is configured to restrict the second end portion from moving toward the first roller.

3. The image forming apparatus according to claim 1, wherein the second roller comprises a roller portion configured to contact with the sheet and a shaft portion supporting the roller portion, the shaft portion having a diameter smaller than that of the roller portion; and wherein the regulating member is configured to contact with the shaft portion for restricting the second roller from moving.

4. The image forming apparatus according to claim 1:

wherein the regulating member is made from resilient material which is resiliently deformable, and is configured to exert regulation force to restrict the second roller from moving by being resiliently deformed; and wherein the re-conveying unit further comprises a receiving portion configured to receive from the regulating member reaction force against the regulation force.

5. The image forming apparatus according to claim 1, wherein the pressing member and the regulating member are integrally formed of a wire member.

6. The image forming apparatus according to claim 5, wherein the wire member has a first portion, a second portion, and a third portion, the first portion positioned opposite to the first roller with respect to the second roller and forming at least a part of the pressing member, the second portion positioned opposite to the first portion with respect to the second roller and forming at least a part of the regulating member, and the third portion forming a U-shape to connect the first portion and the second portion.

7. The image forming apparatus according to claim 1, wherein the pressing member and the regulating member are positioned opposite to each other with respect to the second roller, the pressing member and the regulating member defining a distance therebetween; and wherein the second roller has a supporting portion configured to support force exerted by one of the pressing member and the regulating member, the supporting portion having a diameter smaller than the distance.

* * * * *